US007389780B2

(12) United States Patent
Byun

(10) Patent No.: US 7,389,780 B2
(45) Date of Patent: Jun. 24, 2008

(54) COSMETICS AND COSMETIC TOOL KEEPING CASE

(76) Inventor: Young-Chul Byun, 206-1702, UjangsanLotteNakchundaeAPT, 1145, Hwagok-dong, Gangseo-Gu, Seoul 157-010 (KR)

( * ) Notice: Subject to any disclaimer, the term of this patent is extended or adjusted under 35 U.S.C. 154(b) by 495 days.

(21) Appl. No.: 11/046,677

(22) Filed: Feb. 1, 2005

(65) Prior Publication Data

US 2005/0194021 A1 Sep. 8, 2005

(30) Foreign Application Priority Data

Mar. 3, 2004 (KR) ..... 20-2004-0005589 U

(51) Int. Cl.
*A45D 33/22* (2006.01)
*B65D 19/00* (2006.01)

(52) U.S. Cl. ..... 132/295; 206/379

(58) Field of Classification Search ..... 132/293–297, 132/300–305, 313; 206/581, 823, 378, 379, 206/45.2, 759, 743; 220/507, 523
See application file for complete search history.

(56) References Cited

U.S. PATENT DOCUMENTS 1,845,938 A * 2/1932 Shelgren ..... 132/295
1,948,086 A * 2/1934 Wolfson ..... 132/295
3,441,033 A * 4/1969 Flax ..... 132/295
4,006,821 A * 2/1977 Sautter ..... 206/379
4,126,145 A * 11/1978 Boyd ..... 132/288
4,685,558 A * 8/1987 Filiz et al. ..... 206/1.5
4,821,751 A * 4/1989 Chen ..... 132/295
5,586,653 A * 12/1996 Taveroff ..... 206/362
6,640,813 B2 * 11/2003 Raisner et al. ..... 132/200
7,021,464 B2 * 4/2006 Chen ..... 206/379
2002/0096448 A1 * 7/2002 Lee ..... 206/459.1

* cited by examiner

*Primary Examiner*—Robyn Doan
*Assistant Examiner*—Rachel Running
(74) *Attorney, Agent, or Firm*—Birch, Stewart, Kolasch & Birch, LLP

(57) ABSTRACT

A cosmetics keeping case for storing cosmetics and cosmetic tools which includes an upper movable body, a lower movable body, reception compartments for retaining a number of cosmetics inside the lower movable body and a tool reception element for safely receiving and storing the cosmetic tools, wherein the tool reception element is caused to part 30 elastically rotate by a distortion spring, to a stand up position to make the cosmetic tools accessible, and at the same time, by using a V-shaped spring mounted in the tool reception element to prevent the cosmetic tools from contacting the inner side of the upper movable body and to prevent the brush portions of the cosmetic tools from being pressed flat when the upper movable body is closed on the lower movable body.

2 Claims, 6 Drawing Sheets

COSMETICS AND COSMETIC TOOL KEEPING CASE

This non-provisional application claims priority under 35 U.S.C. section 119(a) based on Patent Application No. 2004-0005589 filed in Korea Mar. 3, 2004, the subject matter of which is herein incorporated by reference.

BACKGROUND OF THE INVENTION

1. Field of the Invention

The present invention relates to a cosmetic case for cosmetics and cosmetic tools, and more particularly, a cosmetic case for housing cosmetics and cosmetic tools including an upper movable body, a lower movable body, reception compartment for storing a number of cosmetics inside the lower movable body, and a tool reception element for safely storing and supporting cosmetic tools, wherein the tool reception element elastically rotates by a distortion spring causing it to stand up and make the cosmetic tools accessible when the upper movable body is opened. At the same time, the cosmetic tools are prevented from contacting the inner side of the upper movable body, when the upper moveable body is closed, by a 'U'-shaped elastic spring mounted in the tool reception element. Thus the cosmetic tools are prevented from being pressed flat when the case is closed.

2. Description of the Related Art

Generally, it is known that women apply make-up before going out and adjust the makeup at any time. Typically employed is a makeup routine comprising the application of a basic foundation, such as tonic water and lotion for protecting facial skin, and then applying color makeup using mascara, eye shadow, lipstick, and the like.

The cosmetic case contains many makeup needs, such as a minor, brushes for mascara, eye shadow and lipstick, and the like. In addition, various alternative cosmetic tools required for the application of makeup can be employed.

Although some of such tools may form makeup sets together with respective cosmetics, they are mostly provided independently of the cosmetics and are only provided in a case for carrying or storing purposes.

Since commonly known cases for carrying cosmetic tools are used merely to store the cosmetic tools, problems are caused when the cosmetic tools adjacent to each other contact each other causing a contaminate appearance in the brushes, and making it difficult to reuse them. Also, it is sometimes difficult to remove the brushes with the hands because the different size brushes have been stored in deeper sections of the cosmetic case.

In recent years, a conventional cosmetic case, as illustrated in FIGS. 6 and 7 of the present application has been proposed which includes a reception case 110 formed with a bracket 110*b* having a first circular hole 110*a* at one end and a second circular hole 110*c* at the other end with a mirror 112 provided on the inner bottom side of the case 110. A tool storing part 114 rotates about a hinge pin 114*a* fitted into the first circular hole 110*a* of the case 110 and is formed with a tool receiving element 114 containing brush-securing grooves 114*b* fitted with grip portions for accommodating a plurality of brushes 116. A distortion spring 118 is operationally associated with the reception case 100 and the tool reception element 114 for applying force to cause the tool reception element 114 to stand up. A transparent cover 120 rotates about a hinge pin 120*a* attached to the lateral side 120*b* of the cover 120 which is fitted into a second circular hole 120*c* and covers the top surface of the case 110. A connection protrusion 120*c* as provided to hook into a connection groove 110*d* of the case 110 at one end thereof.

The cosmetic case with such a construction stores several brushes 116 by forcibly pressing the tool reception element 114 into the case 110 after fitting the brushes into the brush securing groove 114*a* of the tool reception element 114, and then closing the cover 120 while turning the reception element 114 to any desired direction. In the above cosmetic case, the tool reception part 114 can stand up by the elastic power of the distortion spring 118 attached to the hinge pin 114*a* when releasing the connection protrusion part 120*c* and opening the cover 120. Any one of a number of brushes 116 inserted and held in the brush securing groove 114*a* can be selectively drawn out and used.

Accordingly, the user can apply makeup at any time when desired while carrying the case 110. At such a time, by releasing the connection protrusion part 120*c* of the cover 120 from the connection groove 110*d* of the reception case 110 and pushing the cover upward to stand up position, the tool reception part 114 automatically stands up by the action of the distortion spring 118. Then, the user can select any one of the brushes to be used and can put on makeup while holding the grip portion 116*a* of the selected brush 116 and while gripping the reception case 110 with the other hand and looking into the mirror 112 attached to the bottom side of the case 110.

However, in such a conventional cosmetic case, the force pressing the tool reception element 114 is removed when the cover 120 is open and the tool reception element 114 rapidly stands up by the elastic power of the distortion spring 118 causing a rapid release of the brushes 116 stored in the brush securing groove 114*a*. In order to prevent such a release of brushes 116, the user must always gently press the tool reception part 114 while the case is opened thereby resulting in a difficulty in the use thereof.

Furthermore, when the tool reception element 114 is folded and stored in the reception case 110 by closing the cover 120, after fitting the used brushes 116 into the tool reception element 114, the brush portions of the brushes 116 stored in the tool reception element 114 are always placed in contact with each other and are pressed flat because of the elastic power of the distortion spring 118. Therefore, this conventional cosmetic case has the disadvantage of modifying the shape of the brush portions of the brushes 116 when the brushes 116 are held in the reception case 110 for a long time.

SUMMARY OF THE INVENTION

It is therefore an object of the present invention to solve the above problems, in particular, to provide a cosmetic case which includes an upper movable body, a lower movable body, reception parts for storing a number of cosmetics inside the lower movable body, and a tool reception part for safely receiving and supporting the cosmetic tools, wherein the tool reception part elastically rotates by a distortion spring causing it to stand up and make the cosmetic tools accessible when the upper movable body is opened. At the same time, the cosmetic tools are prevented from contacting the inner side of the upper movable body and brush portions of the cosmetic tools are prevented from being pressed flat against the inner side by means of 'U'-shaped elastic spring mounted in the tool reception part when the upper movable body is closed. Also, the cosmetic tools are stored in reception holes of the tool reception part, so that the cosmetic case can inhibit a modification in the shape of the brush portions of the cosmetic tools and stably maintain the same.

BRIEF DESCRIPTION OF THE DRAWINGS

The above object, features and advantages of the present invention will become more apparent to those skilled in the related art from the following detailed description of the preferred embodiments, taken in conjunction with the accompanying drawing, in which.

DETAILED DESCRIPTION OF THE PREFERRED EMBODIMENT

Figure 1:
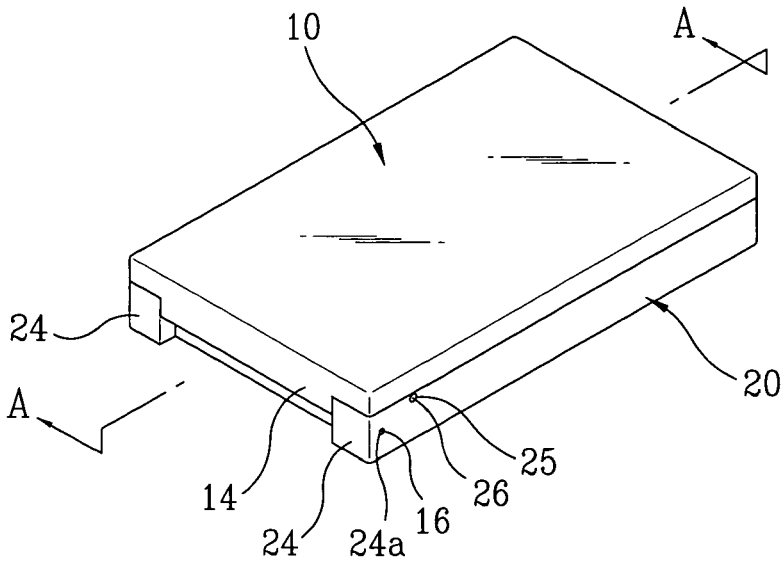
FIG. 1 is a perspective view illustrating the present invention in a closed condition.

The present invention will be described in more detail with reference to the accompanying drawings and following embodiments which are presented for purpose of illustration and should not be construed to limit the scope of the present invention.

As described above, the cosmetic case 1 for housing cosmetics and cosmetic tools 40 includes an upper movable body 10, a lower movable body 20, a tool reception element 30 formed with a number of holes 31 to safely contain cosmetic tools 40, a plurality of chambers 21*a* and 21*b* for storing cosmetics 21*c* inside the lower movable body and a cover plate 23 provided to cover the top portion of the chamber 21*a*. The tool reception element 30 is provided with a 'U' shaped elastic spring 33 installed in the upper movable body 10 and the lower movable body 20 to safely receive the cosmetic tools 40. With such a structure, the tool reception element 30 containing the cosmetic tools 40 can be made to elastically rotate by the distortion spring 35 to a stand-up position so that the cosmetic tools 40 can be withdrawn or inserted when the upper movable body 10 is opened. While closing the upper movable body 10, the tool reception element 30 prevents brush portions of the cosmetic tools 40 from being pressed flat to the inner side of the cosmetic tools 40 by means of 'U' shaped elastic spring 33 mounted in the tool reception element 30 which would result in an inhibiting modification in the shape of the brush portions.

The above structure of the present invention will be described in detail with reference to the accompanying drawings.

Figure 2:
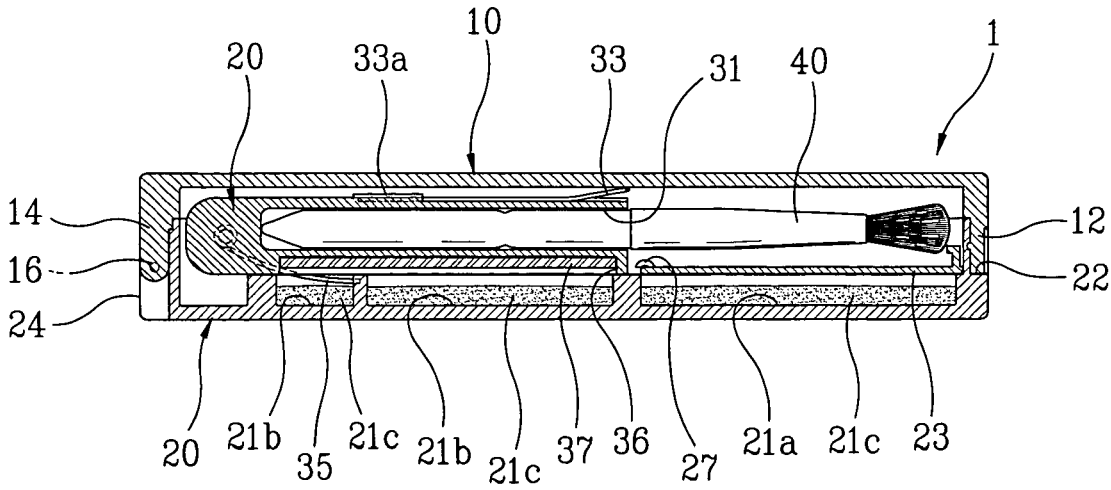
FIG. 2 is a sectional view illustrating a cross-section taken along line A-A of FIG. 1.
Figure 3:
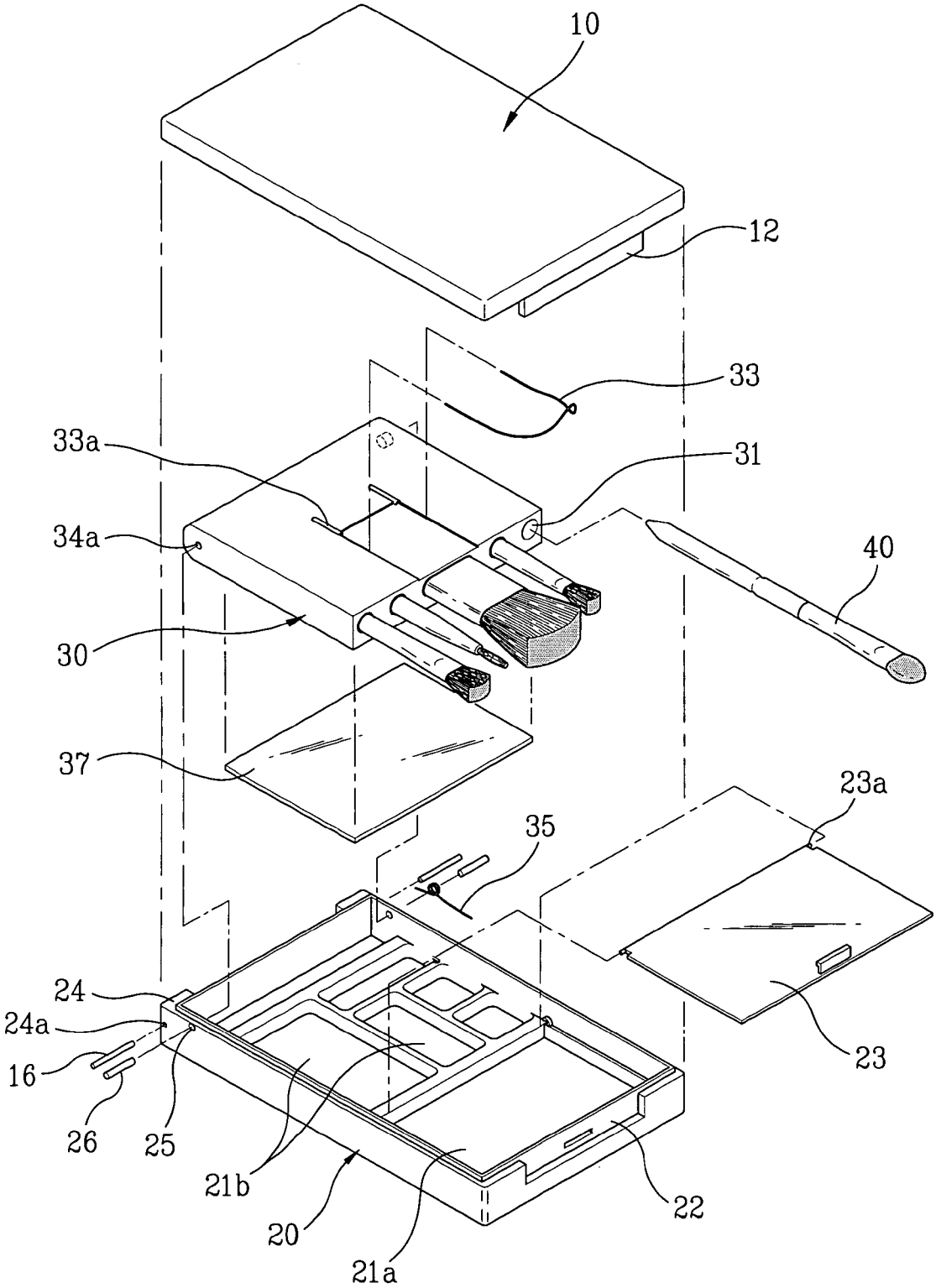
FIG. 3 is an exploded perspective view illustrating the present invention.
Figure 4:
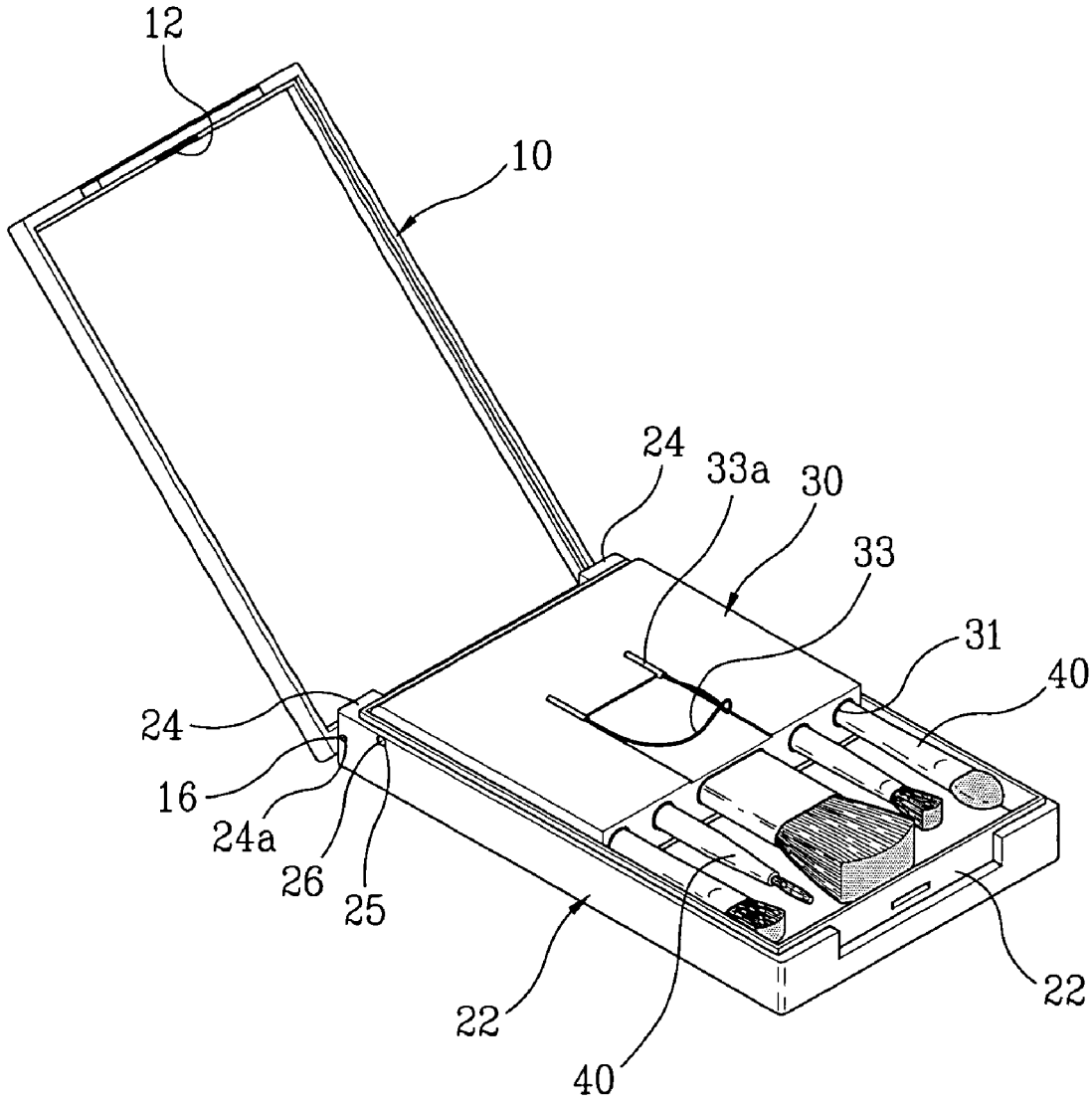
FIG. 4 is a perspective view illustrating the present invention after removing the tipper movable body thereof.
Figure 5:
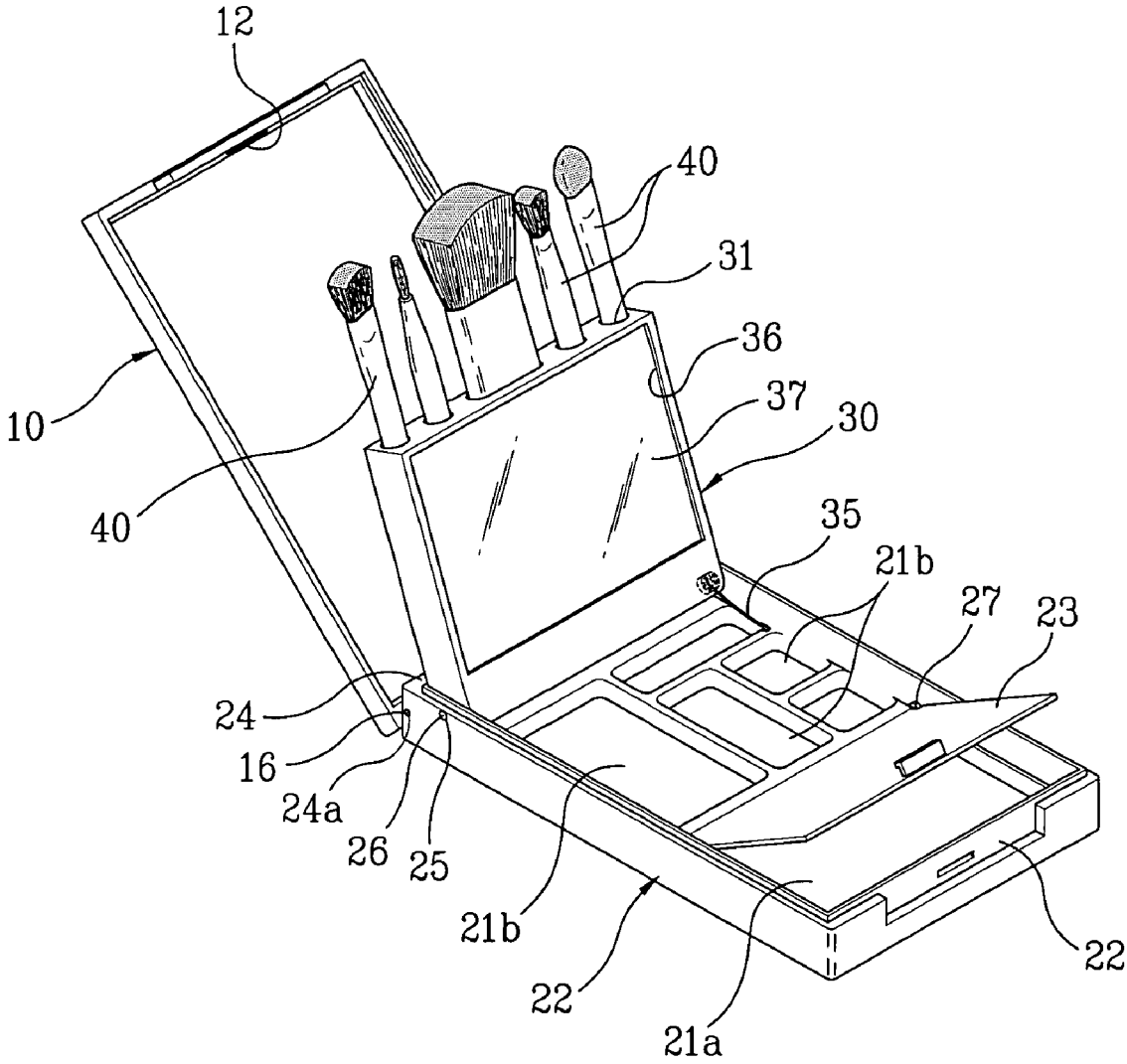
FIG. 5 is a perspective view illustrating the present invention with the tool reception element elastically opened by the distortion spring.
Figure 6:
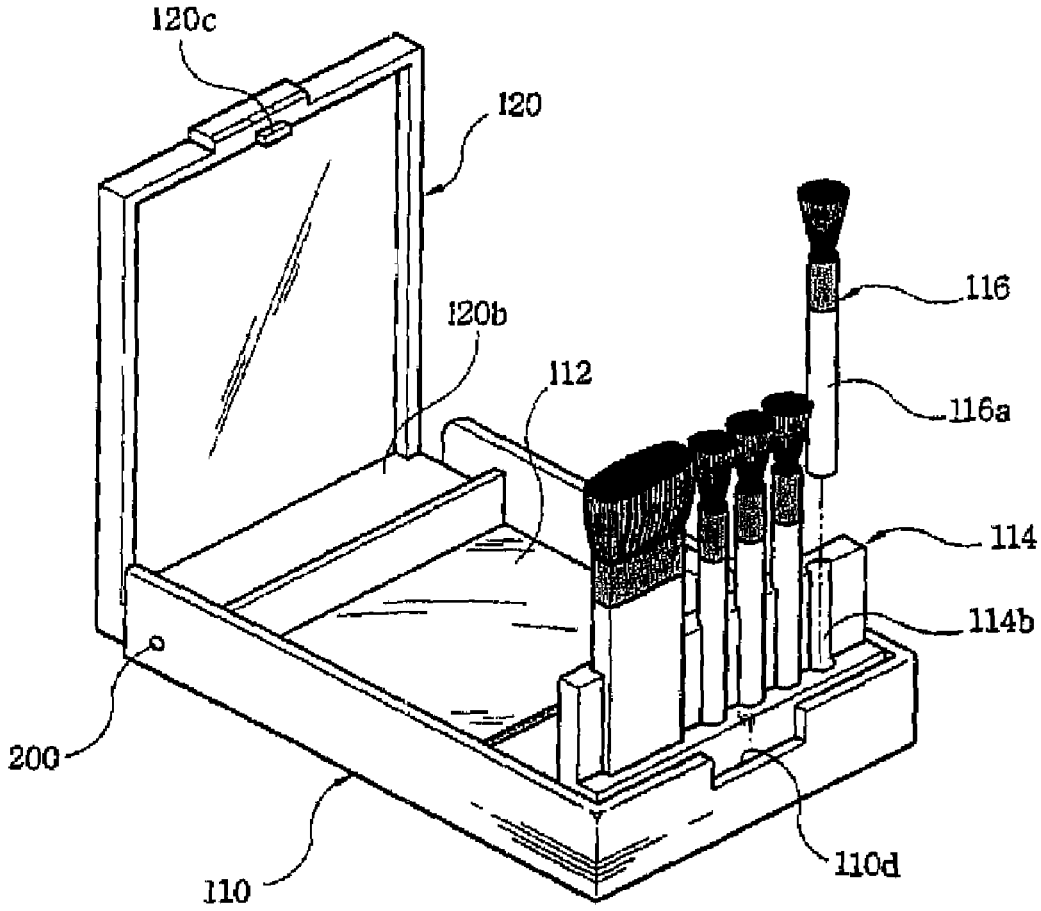
FIG. 6 CONVENTIONAL ART
FIG. 6 is a perspective view illustrating a conventional cosmetic case after opening a cover and standing up brushes therein.
Figure 7:
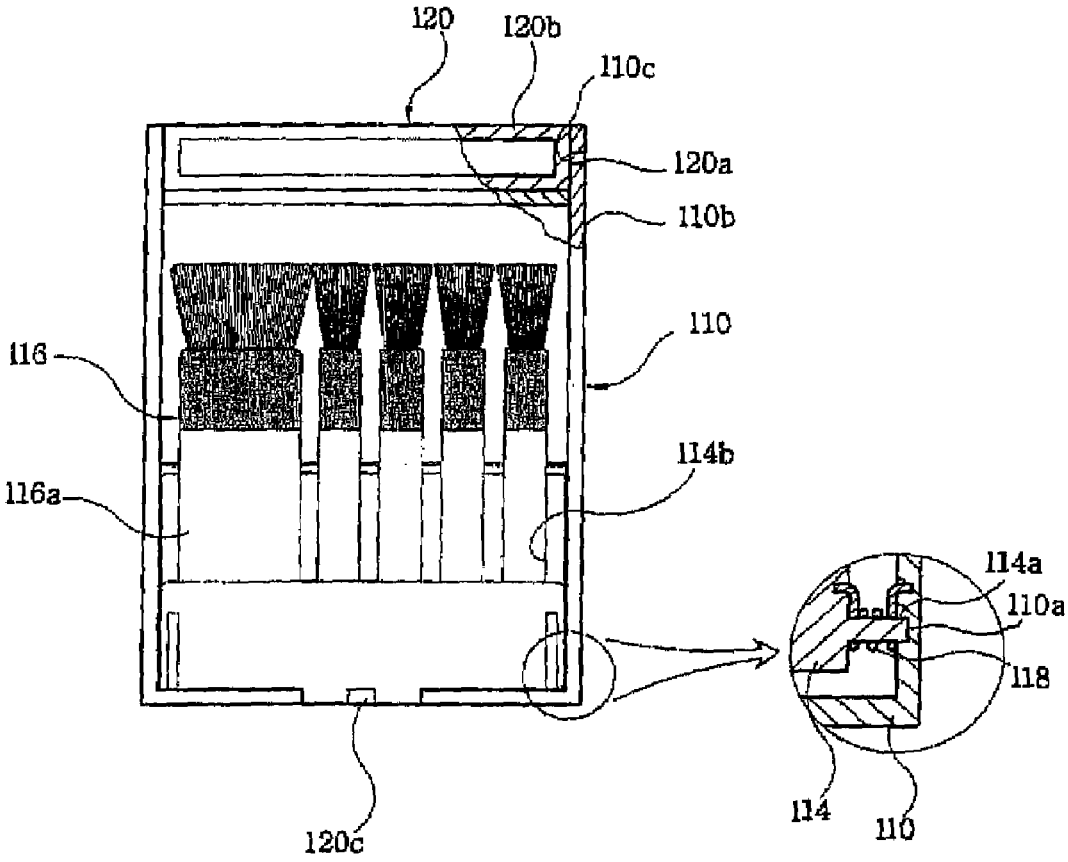
FIG. 7 CONVENTIONAL ART
FIG. 7 is a plan view illustrating a part cut from the conventional case of FIG. 6.

FIG. 1 is a perspective view illustrating the present invention in a closed condition. FIG. 2 is a sectional view illustrating a cross-sectional cut taken along line A-A of FIG. 1. FIG. 3 is an exploded perspective view illustrating the present invention. FIG. 4 is a perspective view illustrating the present invention after removing the upper movable body thereof. FIG. 5 is a perspective view illustrating the present invention with a tool reception element elastically opened by the distortion spring.

The cosmetic case 1 of the present invention includes an upper movable body 10 and a lower movable body 20 connected to the upper movable body 10 by a pin shaft 16, in which the upper movable body 10 has a locking piece 12 on the front side and a bearing 14 for the upper movable body with a bearing hole (not shown in figures) on the rear side.

The lower movable body 20 includes a locking groove 22 on front side and a bearing groove 24 having a bearing hole 24*a* for the lower movable body which is inserted and coupled with the bearing 14 formed at the rear side of the upper movable body 10.

Inside the upper movable body 20 are formed a number of chambers 21*a* and 21*b* for receiving cosmetics 21*c*. A cover plate 23 is formed on the chamber 21*a* to freely rotate about a hinge axis 23*a*.

The tool reception element 30 is mounted inside the upper movable body 10 and the lower movable body 20 and is axially connected therewith by a pin shaft 16. A number of aperatures 31 are formed on the front side of the tool reception element 30 to hold a variety of cosmetic tools 40 such as a brush which is inserted therein. A bearing hole 34*a* is used for mounting the tool reception element at the rear and on both sides. Thus, the tool reception element 30 is adhesively connected to a shaft hole 25 formed on the rear at both sides to freely rotate by means of alternative pin shaft 26.

Moreover, the pin shaft 26 adhesively connecting the tool reception element 30 is also fitted with a distortion spring 35 to apply elastic power to the tool reception element 30 and, to thereby make the tool reception element 30 automatically rise and stand upright while opening the upper movable body 10.

On top side of the tool reception element 30, and formed spring-fitting slits 33*a* for inserting end portions of the 'U' shaped elastic spring 33. Thus, when pushing down the upper movable body 10 to close the case, the cosmetic tools 40 safely stored in the reception holes 31 do not contact inner side of the upper movable body 10, as shown in FIG. 2.

On bottom side of the tool reception element 30, is formed a groove 36 for inserting and fixing a mirror 37 utilized for applying makeup.

Functional effect of the present invention constructed and assembled as described above will be more understood as follows.

According to the present invention as shown in FIGS. 2 to 5, the tool reception element 30 safely storing a plurality of cosmetic tools 40 is elastically received inside the lower movable body 20 using the distortion spring 35. Also, the locking piece 12 for the upper movable body formed on the front side of the upper movable body corresponds to the lower movable body 20 and is locked in the locking groove 22.

Thus the tool reception element 30, built in both of the upper and the lower movable bodies 10 and 20, and containing the 'U'-shaped elastic spring 33 is pressed flat and supported by the inner sides of the upper movable body 10.

Accordingly, the cosmetic case containing cosmetic tools 40 can be carried in a closed condition and, when it is needed to use any of the cosmetic tools 40 such as the brushes, the case can be opened by releasing the locking piece 12 from the locking groove 22.

Thus the pressing force of the upper movable body 10 is eliminated when releasing the locking condition, by removing the locking piece 12 from the locking groove 22. The tool reception element 30 then rises and stands upright due to the elastic power of the distortion spring 35. The 'U'-shaped elastic spring 33 formed on top side of the tool reception element 30 is spaced at a desired distance and supported inside the upper movable body 10, and makes the tool reception element 30 stand up while rotating at the same speed as that of the upper movable body 10. As a result, the present invention prevents the cosmetic tools 40 from shooting out of the tool reception element 30, even when the tool reception element 30 suddenly stands upright, which is a defect of the conventional products.

Thus, various cosmetic tools 40, safely contained in the tool reception element 30 can be drawn out and used by releasing the locking piece 12 for the upper movable body.

Various cosmetics 21*c* provided in the reception parts 21*a* and 21*b*, formed inside the lower movable body 20, can be applied to the cosmetic tools 40 removed from the tool reception element 30, and then, used.

A cover plate 23 is provided on the top side of the reception part 21*a* formed inside the lower movable body 20 to protect the cosmetic 21*c* present in the reception part 21*a*. The reception part 21*a* has fitting holes 27 in both sides thereof which connect with the hinge axis 23*a* of the cover plate 23 to cause it to freely rotate about the hinge axis.

Such a constructed cover plate 23 prevents the cosmetic tools 40 from undesirably contacting the cosmetic and, in turn, protects the cosmetic from the cosmetics tools 40 if the cosmetic tools 40 are pushed down and are held inside of the upper movable body 20 fitted into the tool reception element 30.

Consequently, the present invention, with the construction described above, can easily and simply withdraw the cosmetic tools 40 safely stored in the reception grooves 31 of the tool reception element 30 by opening the upper movable body 10 and raising up the tool reception element 30, whereby access to the cosmetics stored in respective reception parts 21*a* and 21*b* of the lower movable body 20 can be had for applying make-up while looking in the mirror 37 attached to the bottom side of the tool reception element 30.

When the cosmetic case is closed, the tool reception element 30 is spaced from the upper movable body 10 at a desired distance by means of the 'U' shaped elastic spring 33 formed on top side of the tool reception element 30 so that a modification in the shape of the brushes where the brush portions of the cosmetic tools 40 are pressed flat to the inner side of the upper movable body 10, are prevented and a stable housing of the cosmetic tools 40, without movement thereof is ensured.

As described above, the cosmetic case of the present invention includes an upper movable body, a lower movable body and a tool reception element for safely receiving and supporting cosmetic tools, wherein, when the case is opened, the tool reception element is elastically rotated by a distortion spring to a stand up position whereby the cosmetic tools can be easily withdrawn for use with the cosmetics. At the same time, the cosmetic tools are prevented from contacting the inner side of the upper movable body and thus the brush portions of the cosmetic tools are prevented from being pressed flat against the inside by means of the 'U' shaped elastic spring mounted in the tool reception part when the upper movable body is closed. Thus modification in the shape of the brush portions of the cosmetic tools is inhibited.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cosmetic case comprising; an upper movable body and a lower movable body, said upper and lower movable bodies being hinged together at one end by a pin shaft to establish an opened and closed condition, said upper movable body having a bearing hole on a rear side thereof and the lower movable body having a bearing groove with a bearing hole which is coupled with the bearing of the upper movable body, said closed condition defining a cosmetic chamber, said lower movable body containing a plurality of compartments for receiving cosmetics and a cover plate rotatably associated with at least one of said compartments for covering the same when the cosmetic case is closed;

a tool reception element containing a plurality of reception grooves, for storing cosmetic tools, said tool reception element being mounted between the upper and lower movable bodies, said tool reception element being provided with a bearing hole for rotatably connecting it by a pin shaft to a shaft hole at the rear of the lower movable body, said tool reception element further contains a U-shaped elastic spring provided on a top side thereof, and a distortion spring fitted into the pin shaft for causing the tool receiving element to rotate to an accessible position when the cosmetic case is opened.

2. The cosmetic case of claim 1 wherein the upper movable body is provided with a locking means and the lower moveable body is provided with a groove.

* * * * *